United States Patent [19]

Troeger

[11] 4,249,738

[45] Feb. 10, 1981

[54] GAME APPARATUS AND PLAYING PIECE FOR USE THEREWITH

[76] Inventor: Henry Troeger, Lake Rd., Cooperstown, N.Y. 13326

[21] Appl. No.: 967,433

[22] Filed: Dec. 7, 1978

[51] Int. Cl.[3] ..... A63F 1/04

[52] U.S. Cl. ..... 273/144 B; 273/153 S; 273/281; 273/294

[58] Field of Search ..... 273/144 B, 144 R, 144 A, 273/145 B, 145 C, 153 S, 43 R; 35/75, 31 B, 31 D, 33

[56] References Cited

U.S. PATENT DOCUMENTS

| | | | |
|---|---|---|---|
| 975,445 | 11/1910 | McFarland | 273/43 R |
| 1,207,908 | 12/1916 | Harness | 273/144 B X |
| 1,627,414 | 5/1927 | Schaffer | 273/43 R |
| 1,692,796 | 11/1928 | Bishop | 273/43 R |
| 1,866,063 | 7/1932 | Sloan | 273/144 B |
| 2,017,143 | 10/1935 | Bentz | 273/43 R |
| 2,164,682 | 7/1939 | Keith | 273/144 B |
| 2,255,455 | 9/1941 | Shertzer | 273/144 B |
| 2,334,093 | 11/1943 | Hickey | 273/144 A X |
| 2,448,151 | 8/1948 | Noel | 273/144 B |
| 2,555,132 | 5/1951 | Hickey | 273/144 A X |
| 2,704,669 | 3/1955 | Hickey | 273/144 A X |
| 2,810,579 | 10/1957 | Hickey | 273/144 A X |
| 2,906,535 | 9/1959 | Hickey | 273/144 R X |

FOREIGN PATENT DOCUMENTS

| | | | |
|---|---|---|---|
| 571267 | 12/1957 | Italy | 273/144 B |
| 587091 | 4/1947 | United Kingdom | 273/144 B |
| 722014 | 1/1955 | United Kingdom | 273/144 B |

*Primary Examiner*—Richard C. Pinkham
*Assistant Examiner*—Arnold W. Kramer
*Attorney, Agent, or Firm*—Bacon & Thomas

[57] ABSTRACT

A game apparatus includes a playing board having an enclosed space therein which is organized into compartments for playing a game such as solitaire with slidable playing pieces. Each playing piece includes a body portion and an off-center projection wherein the projection is used to both orient the playing piece and retain the playing piece within slots aligned in the compartments. The compartments include a mixing compartment and an array of parallel columnar compartments subdivided into unordered and ordered channels. The unordered channels are connected to the mixing compartment by a gate which delivers single rows of properly oriented playing pieces to the unordered channels for parallel stacking therewithin. The unordered channels are connected to the ordered channels by a passageway which includes a plurality of storage cells for temporarily storing the playing pieces as the playing pieces are shifted to the ordered channels. In a preferred method of using the apparatus, a solitaire-type game is played by shifting unordered playing pieces from the unordered channels to the ordered channels to provide an array of playing pieces in the ordered channels in which playing pieces of the same type or color scheme are sequentially organized.

21 Claims, 12 Drawing Figures

GAME APPARATUS AND PLAYING PIECE FOR USE THEREWITH

BACKGROUND OF THE INVENTION

1. Field of the Invention

This invention relates to game apparatus and playing pieces for use therewith and, more particularly, this invention relates to game apparatus and playing pieces for use therewith wherein the apparatus organizes the playing pieces in rows for subsequent use or manipulation by one using the game apparatus.

2. Prior Art and General Considerations

Solitaire is a pastime engaged in by many people and is usually played with a deck of cards. Cards, however, require a relatively large, level and horizontal surface and must be shuffled and dealt. Furthermore, cards can be blown about by the wind which can frustrate playing outside. Moreover, each deck of cards has fifty-two separate pieces and, if even one is lost or misplaced, the deck can be virtually useless. Consequently, the ordinary deck of cards has physical frustrations associated therewith which result in inconvenience that can reduce both the opportunity to play a game like solitaire and the pleasure associated therewith.

The prior art recognizes these problems with playing cards and the following patents are illustrative of prior art solutions: U.S. Pat. Nos.

1,886,063, Sloan;
1,994,997, Benson;
2,334,093, Hickey;
2,555,132, Hickey;
2,702,708, Warshawsky;
2,896,951, Snow;
3,534,964, Guill.

Note that both U.S. Pat. Nos. 2,702,708 and 2,896,951 utilize stationary cards of representations of cards fixed in rectangular enclosures. In U.S. Pat. No. 2,896,951, a solitaire card game device is disclosed in which the cards are oriented in various directions. U.S. Pat. Nos. 1,866,063; 1,994,977; 2,334,093 and 2,555,132 each disclose playing card simulation games in which playing pieces such as spheres marked with playing card indicia are manipulated. A primary deficiency of the approach embodied in these patents is that there is no structure shown for orienting the spheres for convenient reading. U.S. Pat. No. 3,534,964 is perhaps indicative of other game apparatus for games other than cards in which a plurality of playing pieces are manipulated within the apparatus. Note that the playing pieces are circular and provide no structure for orienting each playing piece in the same direction.

In view of these considerations there is a need for a more convenient and compact game apparatus in which playing pieces are organized and oriented conveniently.

OBJECTS OF THE INVENTION

It is an object of the instant invention to provide a new and improved game apparatus and a playing piece for use therewith or for use with similar game apparatus structures.

It is a further object of the instant invention to provide a new and improved game apparatus for simulating the card game of solitaire.

It is a further object of the instant invention to provide a new and improved game apparatus for simulating an analogous solitaire card game such as that described in the book "Mathematical Magic Show" by Martin Gardner, published by Alfred A. Knopf, 1977, pp. 99–101.

It is a further object of the instant invention to provide a new and improved playing piece for use with a game apparatus wherein the playing piece is oriented through cooperation with the apparatus in accordance with a desired orientation.

It is a further object of the instant invention to provide a new and improved game apparatus and playing pieces for use therewith wherein playing pieces initially distributed randomly are subsequently distributed in rows.

It is a further object of the instant invention to provide a new and improved game apparatus and playing pieces for use therewith wherein a random mix of playing pieces is formed into at least one row of similar playing pieces.

It is a further object of the instant invention to provide a new and improved game apparatus and playing pieces for use therewith wherein a random mixture of playing pieces is distributed in random order in columns from which the playing pieces are then transferred selectively to other columns to form ordered arrays in the other columns.

It is a further object of the instant invention to provide a new and improved game apparatus for simulating card games such as solitaire.

SUMMARY OF THE INVENTION

With these and other objects in mind, the instant invention contemplates a playing piece for use with a game board. The playing piece has a body portion and an off-center projection, while the game board has an opening for receiving the projection and an abutment within the opening whereby when the projection received in the opening rests against the abutment, the playing piece pivots so as to be oriented by gravity.

The instant invention further contemplates a game apparatus including a playing board having an enclosed space therein which is partitioned into compartments in which playing pieces are retained. The compartments include a mixing compartment and columnar compartments with a gating means disposed therebetween. Upon operating the gating means, rows of oriented playing pieces are dispensed into the columnar compartments. Preferably, the columnar compartments include unordered channels disposed just downstream of the gating means and ordered channels, wherein a game is played by moving the playing pieces selectively from the unordered channels to the ordered channels to provide sequential arrangements of the playing pieces in the ordered channels.

DETAILED DESCRIPTION OF THE PREFERRED EMBODIMENT

Figure 1A:
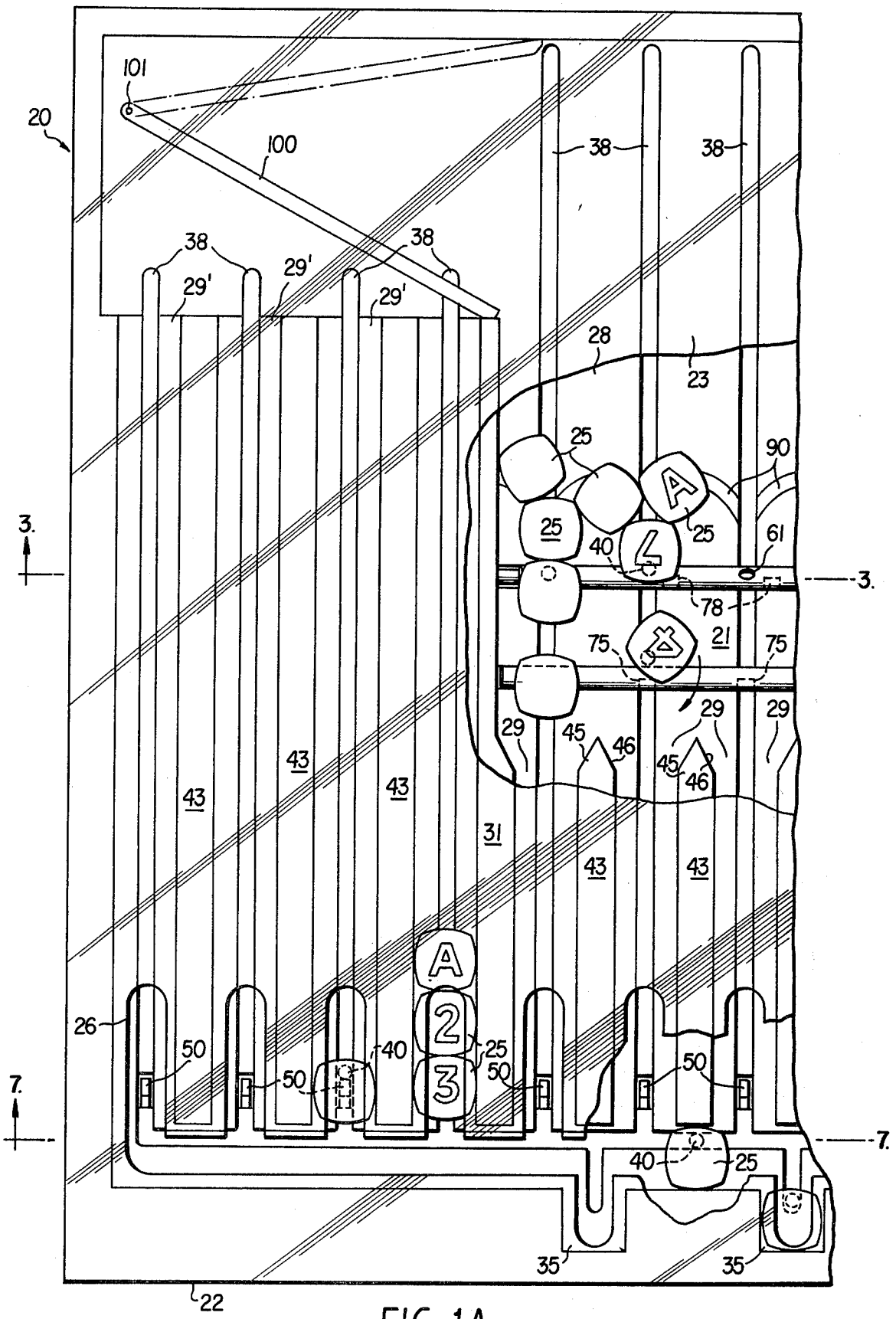
FIGS. 1A and 1B is a plan view of the game apparatus in accordance with the instant invention with a top cover removed in parts.

Referring now to FIGS. 1–8, which show the game apparatus of the instant invention in plan view and in section, a generally rectangular playing board 20 has a base portion 21 with a raised perimeter 22 upon which is secured a transparent cover panel 23 by adhesive, screws or the like. Beneath the cover panel 23 and within the periphery 22, there is defined an enclosed space 24 in which a plurality of playing pieces 25 are retained. In accordance with a preferred embodiment of the instant invention, there are fifty-two playing pieces 25 which are marked so as to correspond with a deck of playing cards. The playing pieces 25 are preferably of four different colors and may, for example, have a red background with white markings, a white background with red markings, a black background with white markings or a white background with black markings.

The enclosed space 24 is partitioned into a mixing compartment 28 and columnar compartments 29 and 29′ by a gate means generally designated by the numeral 30 and a dividing rib 31. The playing pieces 25 are shuffled or mixed in a random pattern within the mixing compartment 28 before being dispensed through the gate means 30 into the columnar compartments 29. Each of the columnar compartments 29 is connected to a passageway 33 which extends normally to the columnar compartments 29 and connects with the other set of columnar compartments 29′ which are on the other side of the partitioning rib 31. In essence, the object of the game is to first transfer the playing pieces 25 from the mixing compartment 28 to the columnar compartments 29 for intermediate storage in an array in which the playing pieces are unordered. The playing pieces are then transferred manually through the passage 33 to the columnar compartments 29′ in such a way as to sequentially position the playing pieces in the columnar compartments 29′ in accordance with their color code. In order to facilitate this transfer of playing pieces 25, the passageway 33 has storage cells 35, preferably four in number, connected therewith so that the playing pieces may be shifted between the storage cells and columns 29 in order to extract the more appropriate playing pieces from the columnar compartments 29.

To provide access for the aforementioned transfer of playing pieces 25, transparent cover 23 has in it an aperature 26 over the bottoms of all columns 29 and 29′, passageway 33 and storage cells 35.

Figure 1B:
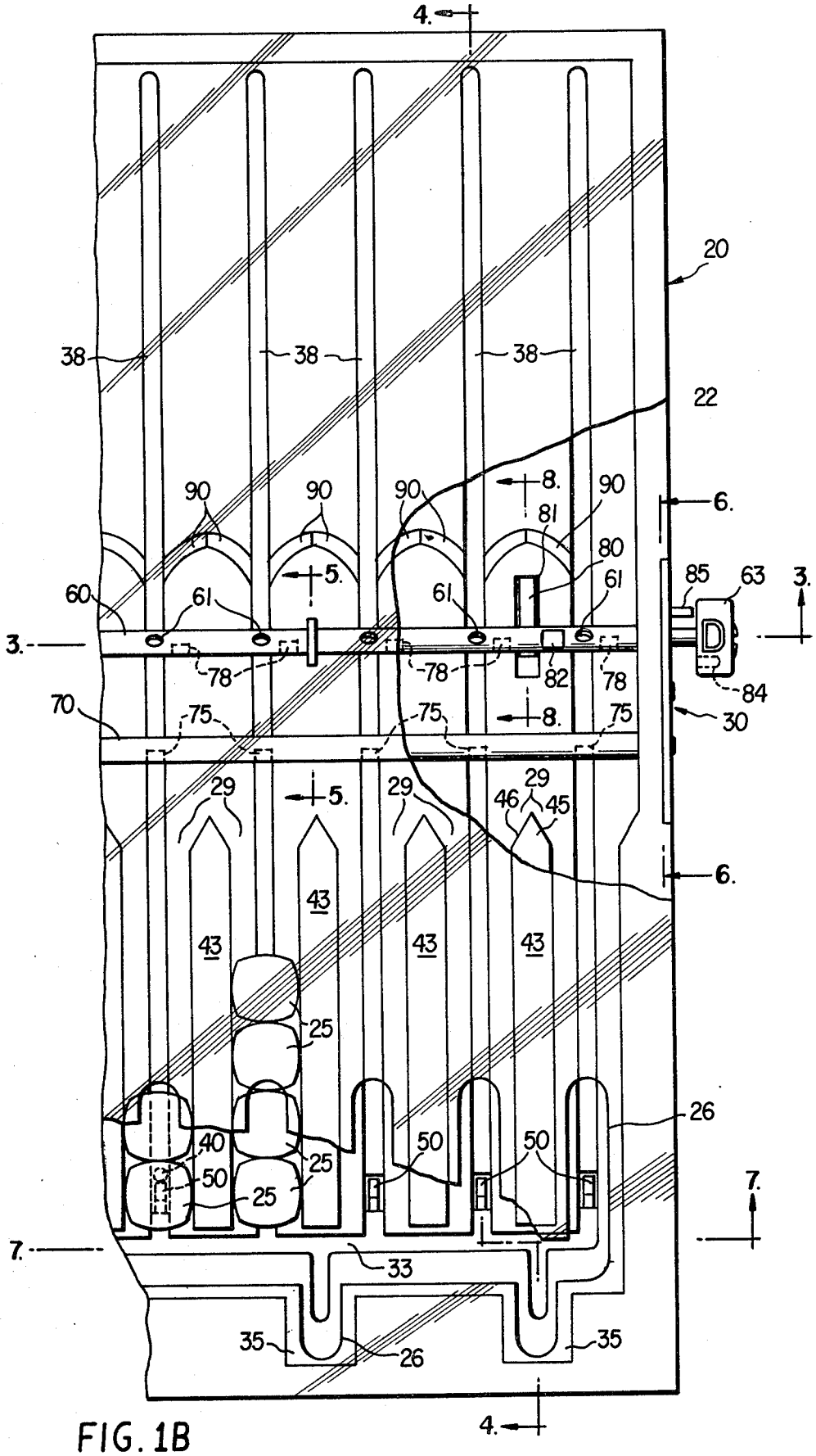
Figure 7:
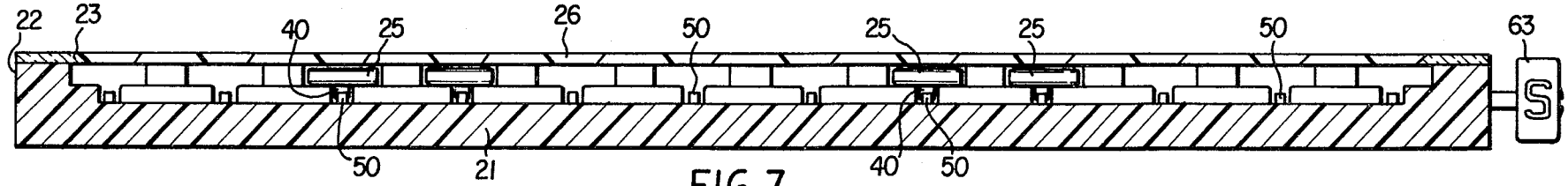

As is readily seen in FIG. 1, the base 21 of the playing board 20 has parallel slots 38 disposed therein which align with the columns 29 and 29′. The slots 38 receive off-center projections 30 which extend from the playing pieces 25 (see FIGS. 9 and 10). As can be seen from FIG. 4, the mixing compartment 28 is relatively open so that the playing pieces 25 can slide around relative to one another when the board 20 is shaken so as to randomly mix the playing pieces 25. Although the slots 38 extend into the mixing compartment 28, the slots are relatively shallow in the mixing compartment. The columnar compartments 29 are essentially defined by parallel ribs 43 which extend from the base 21 to the transparent cover 23, the spaces therebetween defining the columnar compartments and containing the slots 38. As is seen in FIG. 7, the distance between the ribs 43 closely approximates the diameter of the playing pieces 25 so that the ribs 43 provide guide surfaces for the playing pieces. Each rib 43 defining columnar compartments 29 has a converging top portion 45 which converges to a point either by flat or straight surfaces 46 or arcuate surfaces (not shown) in order to, in essence, funnel the playing pieces into the columnar channels 29.

Figure 4:
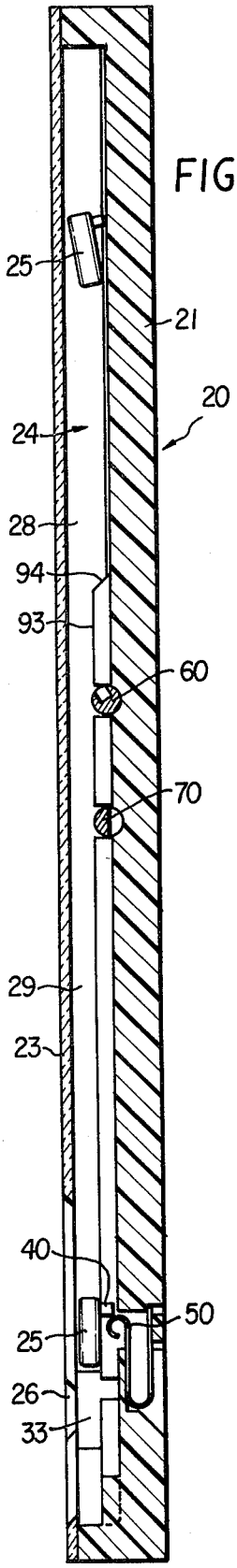
FIGS. 3–8 are sectional views taken through lines 3—3, 4—4, 5—5, 6—6, 7—7 and 8—8 respectively of FIGS. 1A and 1B.
Figure 5:
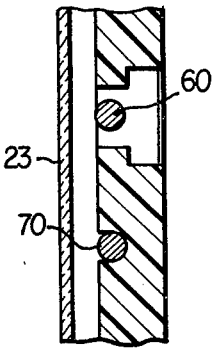
Figure 6:
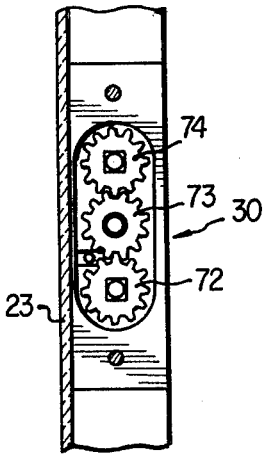
Figure 8:
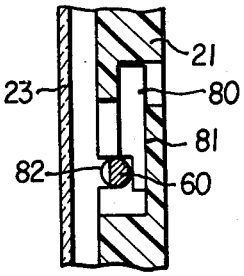
Figure 3:
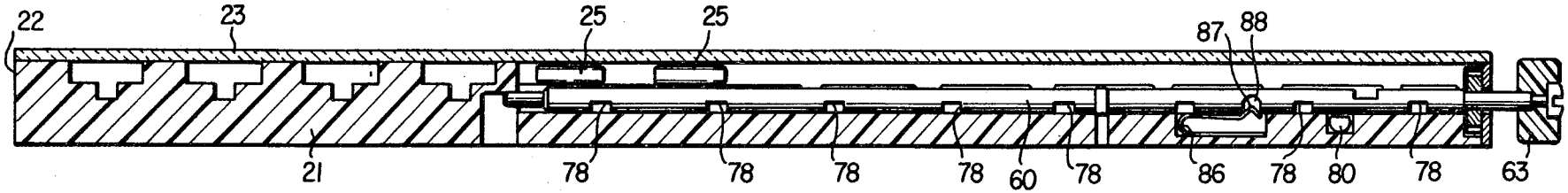

The slots 38 extend into the passageway 33 and at convenient points are provided with stops 50. As is seen in FIG. 4, the stops 50 may be U-shaped springs with curled end portions so that the playing pieces 25 will rest on the stops due to engagement between the stops 50 and the projections 40, but may be moved over the stops by applying enough pressure to the playing pieces to deflect the stops 50. As is seen in FIG. 1, the stops 50 are positioned at the bottom of the columnar compartments 29 and 29′ so that playing pieces will be releasably retained within these compartments.

In accordance with the preferred embodiment, the game apparatus is utilized by positioning the board 20 with a vertical component so that after playing pieces have been mixed in the mixing compartment 28 they can be dispensed by gravity to the columnar compartments 29 in unordered rows. This is accomplished by a two-stage gate means which includes a one-at-a-time gate means and an orienting gate means which constitute the primary components of the gate means 30. The one-at-a-time gate means includes rod 60 which has therein a plurality of bores 61 having a diameter slightly larger than the projections 40 on playing pieces 25. When the rod 60 is positioned in a "dealing" mode to move playing pieces 25 from the mixing compartment 28 to the columnar compartment 29, the bores 61 are aligned with the slots 38 so that as the rod is rotated by a knob 63, the projections 40 of playing pieces 25 resting against the rod while in the mixing compartment 28, will be received in the bores 61 and carried past the rod 60. Since the diameter of each of the bores 61 is such that only a single projection 40 can be accommodated, only one playing piece 25 at a time will be passed through the one-at-a-time gate as the gate rotates.

Positioned beneath the rod 60 is a second rod 70 which is geared to the rod 60 via a gear 72 that meshes with an idler gear 73 and a driving gear 74 rotationally connected to the rod 60. The rod 70 has a plurality of grooves 75 therethrough which are aligned with the slots 38 in the base 21 of the board 20. The grooves 75 rotate out of phase with the bores 61 in the rod 60 so that when the bores pass or deliver the playing pieces 25, the projections 40 engage a surface portion of the rod 70 and are retained on the rod for a short period of time. When the grooves 75, become aligned with the slots 38, the projections 40 are allowed to pass through the slots 75 into the columnar compartments 29 to form unordered banks of playing pieces.

Figure 2:
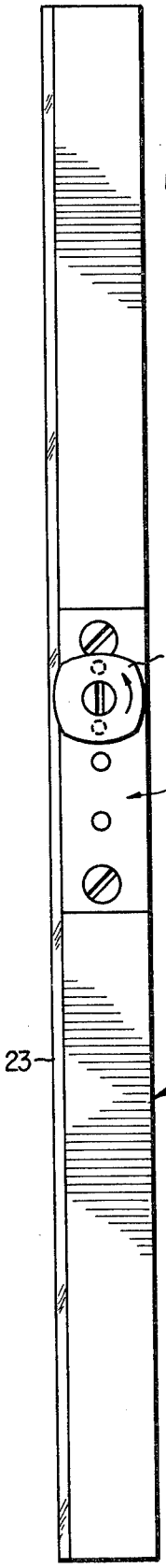
FIG. 2 is an end view showing the right end of the game apparatus of FIG. 1.

As is perhaps best seen in FIGS. 1 and 2, the uppermost rod 60 which contains the one-at-a-time gates also includes grooves 78 which are similar to the grooves 75 in the rod 70. After all of the playing pieces 25 are dispensed through the gate means 30 and are positioned in the columnar compartments 29, the rod 60 is rotated so that the grooves 75 extend in the same direction as the slots 38 so as to be in a "play" position. The knob is then pressed inwardly to align the grooves 78 with the slots 38 so that the projections 40 on the playing pieces 25 can clear both the rod 60 and the rod 70, should one wish to dump the playing pieces from the columnar compartment 29 back into the mixing compartment 28. Furthermore, by aligning the grooves 78 with the slots 38 one can stack the playing pieces 25 in the columns 29 back through the gate means 30 into the mixing chamber 28, if necessary or desired.

There are three releasable restraining means for holding the rod 60 in a desired orientation. In the first arrangement, the knob 60 has a bore 84 therein which receives a pin 85 projecting from the rightward peripheral side of the playing board 20 so as to lock the knob 63 against rotation when it is pushed in to align the grooves 78 with the slots 38. Secondly, (see FIG. 8) a bar 80 is positioned to slide in a slot 81 which underlies the rod 60. The rod 60 has another groove 82 therein which is positioned approximately 180° from the grooves 78. When the rod 60 is positioned so that the bore 84 engages pin 85, bar 80 will drop into engagement with groove 82 to hold the rod 60 in the inward position. Thirdly, (see FIG. 3) a detent spring 86 is positioned within the base 21 so as to project a detent 87 into a groove 88 formed in the rod 60 so as to index the rod 60 by snapping into the grooves 88 as the rod turns. By snapping at selected peripheral positions of the rod 60, the rod is temporarily stopped or slowed during each revolution to tactilely inform the player that a row of playing pieces is in the position to be dispensed or oriented.

A primary feature of the instant invention is the concept of orienting playing pieces 25 before the playing pieces are distributed in columnar compartments 29. Initial orientation is encouraged by having channeling funnels 90 connected to the portions of slots 38 in the mixing compartment 28. This encourages playing pieces 25 in the mixing compartment 28 to be funneled into the slots 38 when the playing board 20 is tilted to a generally upright position by receiving the projections 40 on the playing pieces. Lands on shelves 93 (FIG. 4) from the base 21 serve to urge the playing pieces 25 closer to the transparent cover 23 when the playing board 20 is tilted upright by having a beveled surface 94 (see FIG. 4) facing into the mixing compartment 28. When the playing board 20 is tilted to the upright position, the playing pieces 25 engage the beveled surface 94 and slide up over onto the shelf 93 while the projections 40 are received in the slots 38 due in large part to channeling by the funnels 90.

As described hereinbefore, as the rod 60 turns, each bore 61 receives a single projection 40 regardless of the orientation of the playing pieces abutting the rod 60 adjacent to the bore. Since each bore 61 is large enough to receive only a single projection 40, only one playing piece can be passed by each rotation of the rod 60. As the playing pieces 25 are moved downward due to rotation of the rod 60, they are suspended on the rod 60 by the projections 40. Since the projections 40 are off center with respect to the body portion of the playing pieces 25 or, rather, are not aligned with the center of gravity of the playing pieces, the playing pieces will pivot so as to align the projections and centers of gravity vertically or with the slots 38. In accordance with one embodiment of the instant invention, this will be sufficient to both feed a row of playing pieces 25 and orient the row of playing pieces before they drop into the vertically disposed columnar compartments 29. However, in order to insure that the playing pieces are properly oriented before dropping into the columnar compartments 29, the second rod 70 stops the playing pieces before they fall into the columnar compartments. As each playing piece 25 stops on the rod 70, it will swing or pivot about its projection 40, if it is not already aligned. As is seen in FIG. 1, the rods 60 and 70 are far enough apart so that an open area, or envelope of swing, allows the playing pieces 25 to assume the proper orientation due to the force of gravity. Since the rod 70 has its grooves 75 circumferentially positioned out of phase with the bores 61, there will be a slight delay before the playing pieces 25 drop into the columnar compartments 29 due to registration of the grooves 75 with the slots 38. It is during this delay that the playing pieces 25 orient themselves.

Figure 10:
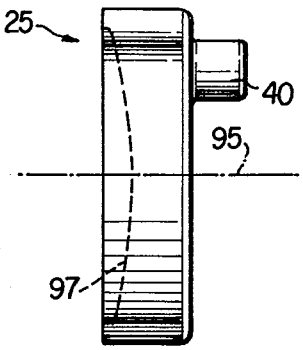
FIG. 10 is a side view of the playing piece of FIG. 9.
Figure 9:
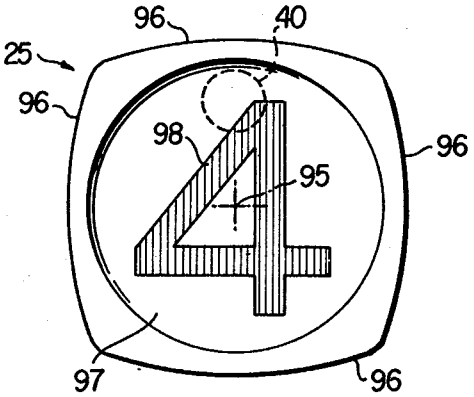
FIG. 9 is an enlarged front view of a typical playing piece, in accordance with the instant invention, utilized with the apparatus of FIGS. 1–8.

Referring now to FIGS. 9 and 10, it is seen that each playing piece 25 includes a relatively large body portion having a center of gravity 95 from which the projection 40 from the rear surface of the playing piece is offset. The body portion is preferably a polygon having four arcuate sides 96. Moreover, the body portion has an indentation 97 in the front surface thereof and indicia 98 formed in the indentation. The indicia 98 may be of one color, while the indentation for front surface of the playing piece 25 is of another color.

A preferred method of playing a game utilizing the apparatus and playing pieces of the instant invention parallels a solitaire game described by Martin Gardner in the book "Mathematical Magic Show," published by Alfred A. Knopf, Inc., New York. The game is begun by setting the knob 63 in a "shuffle" mode whereby no playing pieces can pass through the gate 30. All of the playing pieces are contained in the mixing compartment 28 and the apparatus is shaken preferably in an orbiting manner to mix the playing pieces in a random fashion. The board 20 is then oriented generally in an upright position and tapped or shaken a bit so that the playing pieces 25 pile up on the rod 60 and are distributed across the length thereof while being guided by funnels 90 into general alignment with the slots 38. The knob 62 is then rotated in order to "deal" the playing pieces 25. Each revolution of the rod 60 will deliver one row of playing pieces 25 to the orienting rod 70. The playing pieces will rest on the rod 70 until grooves 75 align with slots 38 and the playing pieces drop down the slots 38 into the columnar compartments 29 to form unordered banks of playing pieces 25. Stops 50 will hold the banks of playing pieces within the compartments 29 in stacks. Just as with the aforementioned solitaire layout, there will preferably be four stacks with seven playing pieces therein and four stacks with six playing pieces therein. It makes no difference which stacks have the six playing pieces and which stacks have seven.

After the playing pieces 25 have all been dealt to the columnar compartments 29, the rod 60 is shifted from the "dealing" mode to the "playing" mode in which the rod is oriented so that the bore 84 will receive the pin 85 when pushed in and align the slots 78 with grooves 38. This allows the playing pieces 25 to slide back into the mixing compartment 28 upon completion of the game or if movement of the playing pieces 25 causes stacks of the playing pieces to back through the gate means 30. As stated hereinbefore, the groove 82 on the rod 60 receives the gravity dropped detent 80 when the rod 60 is in the "playing" mode so that the rod cannot be slid out of the "playing" mode until the board 20 is turned to drop the detent out of engagement with the groove 82 by gravity.

The object of the game is to transfer the playing pieces 25 from the columnar compartments 29 to the columnar compartments 29' so as to form ordered stacks of playing pieces. This is accomplished manually by using a finger or perhaps the eraser of a pencil to slide the playing pieces 25 over the detents 50 one at a time into the passageway 33. The player must plan ahead as to how the playing pieces are moved so that the playing pieces may be accumulated in ordered blanks in the columnar compartments 29'. The four storage cells 35 provide the player with a degree of flexibility since they allow the player to place playing pieces 25, removed from the unordered banks in columnar compartments 29, in "storage" for later use. In playing the game, it is also permissible to move playing pieces 25 from one columnar compartment 29 to another before transferring the playing pieces to the ordered arrays in columnar compartments 29'. Generally, a player may fill the ordered banks in columnar compartments 29' about half the time and win the game. Sometimes it is impossible to win the game. After a while the player's competence improves and the enjoyment from playing the game increases. After the game is over, either because the player is stumped or because the columnar compartments 29' are full with an ordered array, the playing board 20 is tilted to slide the playing pieces 25 into the mixing compartment 28 so that the game may be played again. Playing pieces remaining in the columnar compartments 29 pass back through the grooves 75 in orienting rod 70 and grooves 78 in rod 60 while playing pieces in columnar compartments 29' simply slide out into the compartment 28. If desired, a gate 100 pivoted on a pin 101 can be laid over the top part of columnar compartments 29' to inhibit reentry of pieces when shuffling.

Other games utilizing the apparatus of the instant invention may also be played. For example, one may play stud poker using the dealing feature of applicant's invention by having an opaque cover 23 instead of a transparent cover 23. The playing pieces 25 are simply dealt by turning the knob 63 after being shuffled. The player who turns the knob is dealt a particular "hand" which is matched against the "hands" of subsequent players turning the knob 63.

The foregoing examples and illustrations are merely exemplary of the instant invention which is to be limited only by the following claims

What is claimed is:

1. Game apparatus comprising:

a plurality of playing pieces having directionally unique features;

a playing board having an enclosed space therein for containing the playing pieces;

partitioning means in the enclosed space for dividing the space into compartments, wherein the compartments include:

a mixing compartment for randomly arranging the playing pieces and parallel columnar compartments for holding the playing pieces in an array said playing pieces being movable solely by gravity between said mixing compartment and at least some of said columnar compartments; and said partitioning means including gate means disposed between the mixing compartment and the columnar compartments, the gate means including means engageable with said playing pieces for orienting the playing pieces with said directionally unique features similarly disposed.

2. The game apparatus of claim 1 wherein the parallel columnar compartments include:

a first bank of channels disposed adjacent to the gate means for receiving and storing the playing pieces in oriented array;

a second bank of the channels for storing the playing pieces in a selected array, and wherein the playing board further includes:

passage means connecting the first and second banks of channels through which passage means playing pieces selected from the first bank of channels can be manually moved to selected channels in the second bank of channels.

3. The game apparatus of claim 2 further including storage means connected to the passage means for storing playing pieces temporarily after the playing pieces have been removed from the first bank of channels.

4. The game apparatus of claim 1 wherein each of the playing pieces include a body portion and a projection displaced from the center of gravity of the body portion, wherein the projection engages the orienting means of the gate means to orient the playing pieces by gravity.

5. The game apparatus of claim 4 wherein the gate means includes at least one rod, disposed transverse to the columnar compartments, whereinthe orienting means are surface portions of the rod which are engaged by the projections and wherein the rod includes recesses therein which are registered selectively with the columnar compartments to allow the playing pieces to move past the rod by receiving the projection through the recesses.

6. The game apparatus of claim 5 further including means for rotatably mounting the rod and wherein the recesses are bores within the rod which receive the projections of the playing pieces one at a time so that each bore passes a single playing piece for each revolution of the rod.

7. The game apparatus of claim 6 wherein slot means extend along each columnar compartment and adjacent to the rod for receiving and guiding the projections of the playing pieces.

8. The game apparatus of claim 7 wherein the slot means extend into the mixing compartment.

9. The game apparatus of claim 7 or 8 wherein the first recited rod includes grooves axially and circumferentially displaced from the bores and wherein the means for rotatably mounting the first recited rod permits axial motion of the rod to an open gate position to align the grooves with the slot means allowing a plurality of playing pieces to slide past the first mentioned rod.

10. The game apparatus of claim 6 wherein the gating means further includes a second rod rotatably disposed downstream of the first recited rod wherein the second rod includes surfaces for engaging the projections to assure pivoting of the playing pieces to the desired orientation and wherein the second rod includes grooves adjacent the surfaces to pass the playing pieces when the second rod is rotated to align with the slot means to receive the projections.

11. The game apparatus of claim 10 wherein the columnar compartments comprise:

a first bank of channels disposed downstream of the additional rod for storing the playing pieces in an oriented array, and a second bank of channels for storing the playing pieces in a selected array wherein the second bank of channels is parallel to the first bank of channels, and an outward opening aperture to provide access to the playing pieces.

12. The game apparatus of claim 11 further including:

passage means extending normal to the first and second banks of channels and registering with each channel wherein playing pieces selected from the first bank of channels may be manually moved to the second bank of channels through the passage means, and stop means in the first bank of channels for inhibiting movement of the playing pieces to the passage means whereby the playing pieces linearly accumulate in the first channel behind the stop means as they pass the gate means so that the playing pieces may be selectively removed to the passage means one at a time.

13. The apparatus of claim 12 further including storage means connected to the passage means for storing playing pieces temporarily after they have been removed from the first bank of channels.

14. The game apparatus of claim 13 wherein the first recited rod includes grooves axially and circumferentially displaced from the bores and wherein the means for rotatably mounting the first recited rod permits axial motion of that rod to an open gate position to align the grooves with the slots allowing a plurality of playing pieces to slide past the first mentioned rod.

15. The game apparatus of claim 14 further including detent means on the game board for engaging the first recited rod to hold the said rod in the open gate position when the game is in a playing mode.

16. The game apparatus of claim 15 wherein the slot means extends into the mixing compartment to allow linear accumulation of the playing pieces in the mixing compartment.

17. The game apparatus of claim 16 wherein the detent means is gravity biased.

18. The game apparatus of claim 17 further including means for coupling the rods together for simultaneous rotation upon rotation of one rod, wherein the rotational relation is fixed with the grooves of both rods registering simultaneously with the slots when the first recited rod is in the open gate condition and with the grooves of the additional rod being out of registration with the slots when the bores of the first rod face down the slots to pass single playing pieces, whereby the playing pieces are suspended temporarily on the second rod by the projections to assure proper orientation of the playing pieces before the playing pieces pass into the channels.

19. The game apparatus of claim 18 wherein the coupling means are gears and the fixed rotational relation is established by mating gear teeth.

20. The game apparatus of claim 18 further including indexing means for releasably holding the rods in selected rotational positions.

21. The game apparatus of claim 10 or claim 14 further including means for coupling the rods to one another for simultaneous rotation.

* * * * *